United States Patent [19]

Frank

[11] Patent Number: 4,641,360

[45] Date of Patent: Feb. 3, 1987

[54] CARRYING BAG WITH INTERLOCKING HANDLE PORTIONS

[75] Inventor: Helmut Frank, Munich, Fed. Rep. of Germany

[73] Assignee: Manzinger Papierwerke KG, Munich, Fed. Rep. of Germany

[21] Appl. No.: 703,399

[22] Filed: Feb. 20, 1985

[30] Foreign Application Priority Data

Feb. 20, 1984 [DE] Fed. Rep. of Germany ... 8405096[U]
Mar. 27, 1984 [DE] Fed. Rep. of Germany ... 8409385[U]
Jun. 29, 1984 [DE] Fed. Rep. of Germany ... 8419598[U]

[51] Int. Cl.[4] ..... B65D 33/16

[52] U.S. Cl. ..... 383/15; 383/16; 383/63

[58] Field of Search ..... 383/15, 63, 65, 95, 383/16, 68

[56] References Cited

U.S. PATENT DOCUMENTS

| | | | |
|---|---|---|---|
| 3,311,144 | 3/1967 | Lindley | 383/63 X |
| 3,339,823 | 9/1967 | Bessermann-Nielsen | 383/15 |
| 3,353,741 | 11/1967 | Kamins et al. | 383/15 |
| 3,462,068 | 8/1969 | Suominen | 383/15 X |
| 3,529,317 | 9/1970 | Schwarzkopf | 383/15 X |
| 3,987,958 | 10/1976 | Kamins et al. | 383/15 |
| 4,387,846 | 6/1983 | Du Corday | 383/16 X |

FOREIGN PATENT DOCUMENTS

| | | | |
|---|---|---|---|
| 1954944 | 5/1971 | Fed. Rep. of Germany . | |
| 90188 | 10/1967 | France | 383/15 |
| 1575657 | 9/1980 | United Kingdom | 383/15 |

*Primary Examiner*—William Price
*Assistant Examiner*—Bryon Gehman
*Attorney, Agent, or Firm*—Fleit, Jacobson, Cohn & Price

[57] ABSTRACT

A carrying bag comprises two substantially rectangular sheets of plastic film, which constitute mutually opposite walls and are joined along three edges and have free edge portions defining an opening of the bag, also comprising a stiffening bar, which is made of synthetic thermoplastic material and is parallel to the free edge portion of one of said walls and is welded to the inside surface of said one wall at said free edge portion, said bar having an intermediate portion which is integral with a U-shaped handle, which is adapted to be positively connected to the free edge portion of the other wall. The free edge portion of the other wall of the bag is welded on its inside surface to a second stiffening bar, which is made of synthetic thermoplastic material and is parallel to the free edge portion of said other wall, and a slot is defined by said second bar and by a relatively low, U-shaped slot-defining member having legs which are integrally joined to said second bar.

8 Claims, 9 Drawing Figures

CARRYING BAG WITH INTERLOCKING HANDLE PORTIONS

BACKGROUND OF THE INVENTION

1. Field of the Invention

This invention relates to a carrying bag comprising two substantially rectangular sheets of plastic film, which constitute mutually opposite walls and are joined along three edges and have free edge portions defining an opening of the bag, also comprising a stiffening bar, which is made of synthetic thermoplastic material and is parallel to the free edge portion of one of said walls and is welded to the inside surface of said one wall at said free edge portion, said bar having an intermediate portion which is integral with a U-shaped handle, which is adapted to be positively connected to the free edge portion of the other wall.

2. Description of the Prior Art

In a carrying bag of that kind known, e.g., from Published German Application No. 19 54 944 that wall which is opposite to the wall which is provided with the handle-carrying bar has a longitudinal extension, which is adapted to be reversely folded and which near its fold line is formed with a slot for receiving the handle. When that known bag has been filled, the flap consistuted by the reversely folded extension may be pulled upwardly by the handle so that the bag may partly open and dust or rain may enter the interior of the bag. Besides, the carrying bag will have an unpleasant appearance when the flap has been raised.

SUMMARY OF THE INVENTION

For this reason it is an object of the invention to provide a carrying bag which is of the kind described first hereinbefore and which will be reliably closed and is pleasing in appearance.

In one aspect of the invention this object is accomplished in that the free edge portion of the other wall of the bag is welded on its inside surface to a second stiffening bar, which is made of synthetic thermoplastic material and is parallel to the free edge portion of said other wall; and a slot is defined by said second bar and by a relatively low, U-shaped slot-defining member having legs which are integrally joined to said second bar.

In the carrying bag according to the invention the free edge portion of the other wall is also stiffened by a bar so that said other wall cannot sag in an unsightly manner when the bag has been filled. When the bag is closed, the second stiffening bar is directly connected to the handle, which extends through the slot defined by the second bar, so that a reliably closing of the bag is ensured.

The carrying bag in accordance with the invention affords also an improved protection against theft because the bag cannot be opened unless the legs of the handle are forced in a readily noticeable manner through the slot defined by the second bar.

In accordance with a preferred further feature, the stiffening bars are substantially coextensively in contact with each other when the bag is closed and are provided on their confronting side faces with projections and complementary projections and recesses, which are interengageable like snap fasteners for holding the bars together. Said protections and recesses which are similar to snap fasteners will be centered relative to each other in the carrying bag in accordance with the invention in that the handle is pushed through the slot so that the fasteners will be closed simply in that the bars are urged toward each other.

It is known to make carrying bags which are provided at both free edges of their walls with bars, which are welded to said walls and integral with U-shaped handles, which are provided with fastening means similar to snap fasteners. When such known carrying bags are to be closed, the fastening elements must be manually aligned with each other. This operation is difficult and for this reason is often omitted so that the bags will not be closed and their contents may be affected by dust or rainwater. Besides, the snap fastener elements may damage delicate materials or surfaces (distortion of stitches). The carrying bag in accordance with the invention can be closed simply in that the U-shaped handle is pushed through the slot defined by one bar and is then grasped so that the carrying bag will be automatically pulled to its closed position and will be kept closed under the weight of its contents. As a result, the bag will be closed much more quickly than is possible with conventional carrying bags. The fasteners have a substantial surface area and ensure an improved seal of the interior of the bags against an ingress of rain and dust.

The legs of the handle are preferably provided with outwardly projecting hooks closely above the stiffening bar and when the bar is closed said hooks interlock with the short legs of the U-shaped member which defines the slot. Said hooks are suitably provided on their top with beveled faces, on which web portions of the slot-defining U-shaped member can slip until said web portions snap behind the projecting hooks, which are defined by substantially horizontal recesses at the ends of the beveled faces.

The legs of the handle may be provided with step-forming projections or beads on their forward side, which is engaged by the crosspiece of the slot-defining U-shaped member when the handle has been inserted through the slot, and said projections or beads are adapted to snap over said crosspiece.

The carrying bag in accordance with the invention can be handled conveniently and can be closed in a simple and reliable manner simply in that the crosspiece of the slot-defining member is caused to snap over the steps or projections. When the U-shaped handle has been pushed through the slot and is grasped in order to close the carrying bag, the carrying bag will be automatically closed in that the weight of the contents of the bag pulls down the forward wall of the bag so that the slot will be pulled to a closing position, in which the crosspiece of the slot-defining member is latched and the stiffening bars welded to the walls of the bag engage each other so that the bag will remain closed.

The projections need not extend throughout the width of the legs of the handle but may be dot- or boss-shaped. The projections are suitably provided with ramp surfaces, which taper toward the outer end of the handle so that the crosspiece of the slot-defining member will snap more easily to the closing position.

The legs provided with latching hooks may be connected by a handle portion or by a crosspiece which carries a hook or an eye. In the latter case, the bags may be filled with merchandise to be sold and may be hung on a stand.

The handle, the U-shaped member defining the slot, and the associated bars may consist of injection moldings made of soft, flexible plastic so that said parts will be sufficiently flexible to facilitate the pushing of the handle through the slot. The handle and the stiffening bars are suitably stiffened by having a profiled shape. This will also permit a saving of material.

In accordance with a second aspect of the invention the object stated is accomplished in that the free edge portion of the other wall of the bag is welded on its inside surface to a second stiffening bar, which is made of synthetic thermoplastic material and is parallel to the free edge portion of said other wall, and said second bar has an intermediate portion which is enlarged in width by being provided with an upwardly extending web, which carries lugs, which longitudinally project from opposite ends of said web, said web is shorter than the distance between the legs of the handle, and in a projection on the handle said lugs extend at least approximately as far as to the legs of the handle when the bag is closed.

The carrying bag in accordance with that second embodiment can also be handled conveniently and can be closed in a simple and reliable manner in that the lugs are inserted or forced through the eye which is constituted by the handle and the lugs are then caused to interlock with the legs of the handle. When the lugs have been inserted or forced through the U-shaped handle and the latter is then grasped, the bars which stiffen the free edge portions of the walls of the bag will be centered relative to each other in the the step-forming lugs bear on enlarged portions of the legs of the handle or of the bar that is joined to said handle.

The lugs suitably protrude beyond the legs of the handle. The lugs may be offset from the plane of the web so that when the lugs have been inserted through the eye that is defined by the handle it will not be necessary to force the lugs behind the legs of the handle.

The legs of the handle may be provided on their outside surfaces with projecting hooks for interlocking with the lugs so that the lugs which have been inserted through the handle eye will snap to their closed position under the action of the weight of the contents of the bag or under a pressure applied by hand.

The free end portions of the lugs may be curved to extend behind the legs of the handle and the legs of the handle may be provided on their narrow outside surfaces with hook-shaped portions for interlocking with the free end portions of the lugs.

DETAILED DESCRIPTION OF THE PREFERRED EMBODIMENTS

Figure 1:
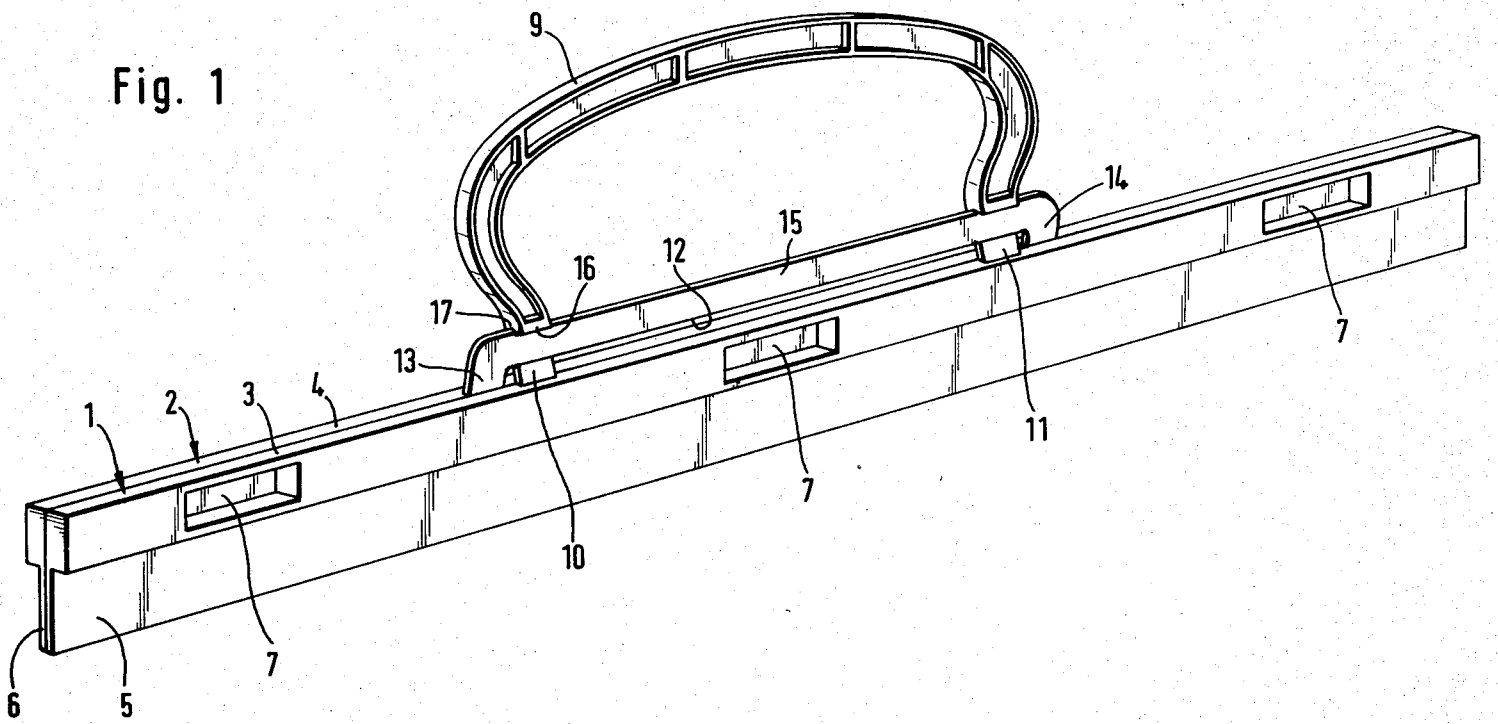
FIG. 1 is a perspective view showing a handle, a slot-defining U-shaped member as well as stiffening bars which are in contact with each other and those portions of the walls of the carrying bag to which said bars have been welded.

The handle 1 and the slot-defining member 2 consist of channel-shaped stiffening bars 3, 4. Strips 5, 6 which constitute welding tags have been integrally formed with the lower flanges of said channel bars and extend at right angles to said flanges. One of the channel members is provided with spaced apart lugs 7, which are substantially rectangular. The other of said channel members has recesses 8, which are complementary to the lugs 7, so that the profiled bars 3, 4 can be interengaged.

The bar 3 is provided with a U-shaped handle 9, which has legs 10, 11, which are joined to the upper flange of the channel bar 3. The upper flange of the channel bar 4 is provided with a low U-shaped member, which defines a slot 12 with the bar 4. That U-shaped member comprises short legs 13, 14, which are integrally formed with the bar 4, and a crosspiece 15 connecting the legs 13, 14. The rectancular slot 12 has the same size as the vertical projection of the handle 9 on the upper flange of the bar 3.

Figure 4:
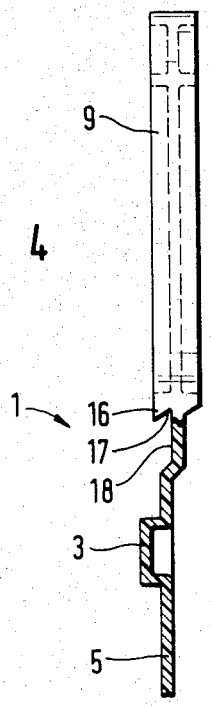
FIG. 4 is a side elevation showing the handle partly in section.
Figure 5:
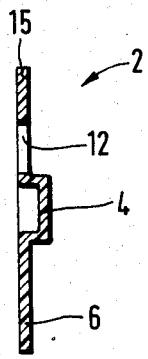
FIG. 5 is a sectional view showing the slot-defining member.

The handle 9 comprises a substantially part-oval crosspiece and legs, which depend from the crosspiece and are joined to it by respective bends. Said depending legs are provided with step-forming hooks 16, 17 on that side which is engageable by the crosspiece 15. As is best visible in FIG. 4, said hooks 16 are defined by steps 17 formed in the legs of the handle 9. The step 17 may be adjoined by a groove 18, which has substantially the same width as the crosspiece 15 which defines the slot 12.

Figure 2:
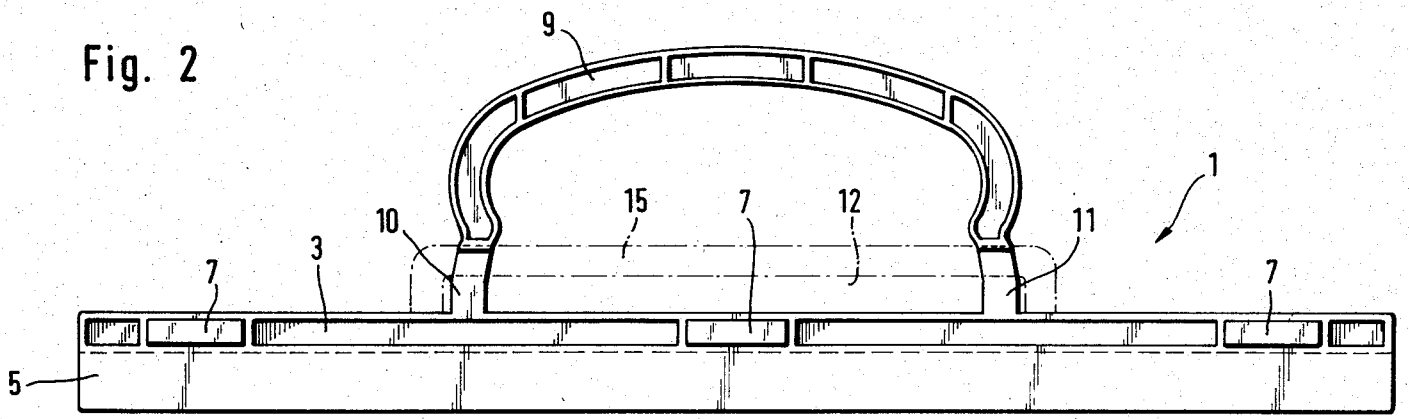
FIG. 2 is a side elevation showing the handle.
Figure 3:
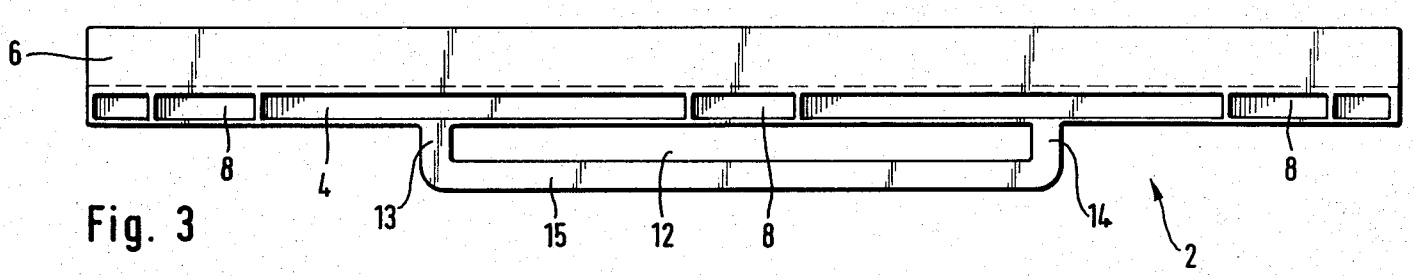
FIG. 3 is a side elevation showing the slot-defining member.

In FIG. 2 the position of the crosspiece 15 in the closed position of the bag is indicated by dotted lines. The step-forming hook 17 extends over the crosspiece 15 to lock the latter. The inside surfaces of the short legs 13, 14 adjoin the outside surfaces of the handle legs 10, 11 so that the bars 3 and 4 of the closed bag interlock and are centered relative to each other by the handle and the slot-defining member.

In the embodiment shown in FIGS. 6 to 9 the channel-shaped bars 101, 102 are connected to the free edge portions of the bag walls by welded joints not shown in detail.

The lower flanges of said channel bars are integrally formed with protruding strips 103, 104, which constitute welding tags extending at righ angles from said flanges. Each channel bar is formed with spaced apart, rectangular lugs 105, which can extend into complementary recesses 106 of the other channel bar to latch said channel bars to each other.

The bar 101 is integrally formed with a U-shaped handle 107, which at its top has a stiffening I-section crosspiece. The legs 108, 109 of the handle are joined to the upper flange of the bar 101.

The upper flange of the bar 102 has an intermediate portion which is integrally formed with an upwardly protruding web 110 so that said bar is enlarged in width. That web is provided at opposite ends with longitudinally protruding lugs 111, 112.

When it is desired to close the carrying bag, the lugs 111, 112 are inserted or forced through the handle eye so as to interlock with the legs 108, 109 of the handle.

Figure 8:
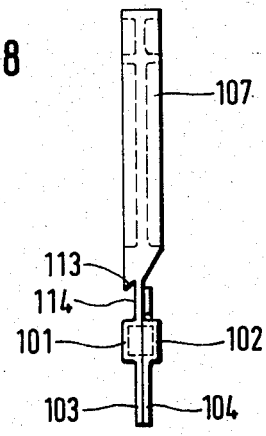
FIG. 8 is a side elevation showing the narrow sides of the latched bars of FIG. 6

The lock the lugs 111, 112, the legs 108, 109 of the U-shaped handle 107 may be provided with projecting hooks or with projections 113, which define a groove 114, as is shown in FIG. 8, which receives and interlocks with the lugs 111, 112. In FIG. 8 the bars 101, 102 are shown in a position in which they are aligned with each other but the lugs 111, 112 do not interlock with the legs.

Figure 9:
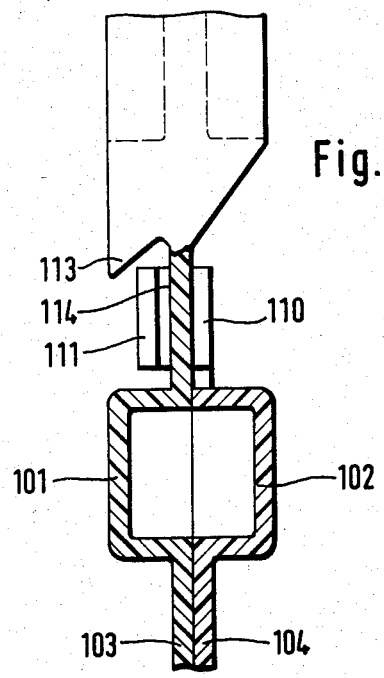
FIG. 9 is a view that is similar to FIG. 8 and shows latched bars on a larger scale.
Figure 6:
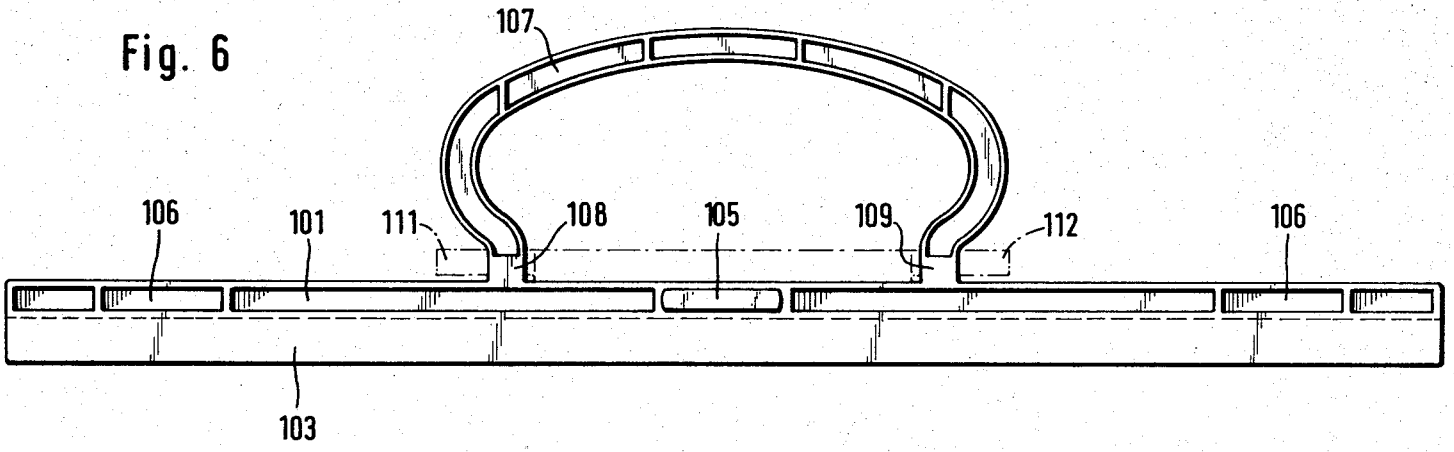
FIG. 6 is a side elevation showing another embodiment comprising two latched bars, one of which is provided with a handle and the other with lugs interlocking with the handle.
Figure 7:
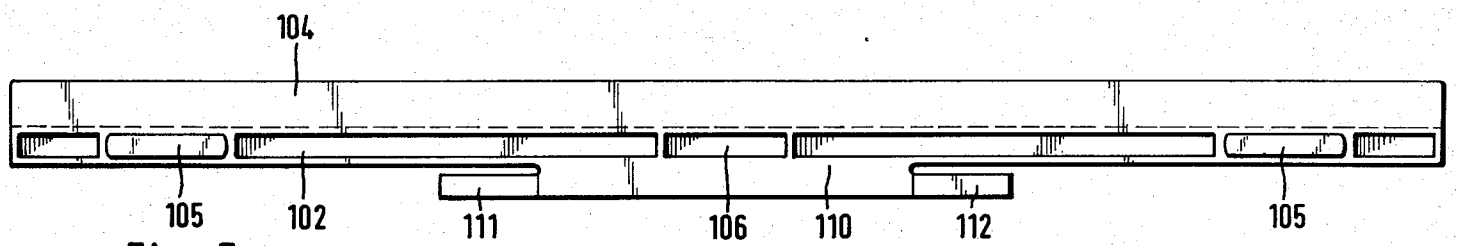
FIG. 7 is a side elevation showing the bar provided with the interlocking lugs.

In the embodiment shown in FIG. 9 the lugs 111, 112 are offset from the plane of the intermediate web 110.

What is claimed:

1. A handle for a bag, said handle comprising:

a first stiffening bar adapted to be secured adjacent to a top of a bag on a first wall of the bag, a second stiffening bar adapted to be secured adjacent to the top of the bag on a second wall of the bag which is located opposite to said first wall, a U-shaped handle having a crosspiece and legs, said legs being integral with said first stiffening bar, a U-shaped member having a crosspeice and legs, said legs being integral with said second stiffening bar, a groove defined in each of the legs of said U-shaped handle at a portion of said legs adjacent to said first stiffening bar, said grooves being located at a distance above said first stiffening bar which is substantially equal to a distance that the crosspiece of said U-shaped member projects from said second stiffening bar, a slot defined by said U-shaped member and said second stiffening bar for receipt of said U-shaped handle through said slot so that when said U-shaped handle is inserted through said slot, the crosspiece of said U-shaped member fits within and is locked in place in said grooves by the weight of contents in the bag pulling downwardly on said stiffening bars, and an opening defined between a lowermost surface of the crosspiece of the U-shaped handle and an uppermost surface of the crosspeice of said U-shaped member when the crosspiece of said U-shaped member is locked in said grooves, said opening receiving the hand of a person grasping the bag by the crosspiece of said U-shaped handle.

2. A carrying bag according to claim 1, characterized in that the first and second stiffening bars are substantially coextensively in contact with each other when the bag is closed and said first and second stiffening bars are provided on their confronting side faces with projections and complementary recesses, which are interengageable like snap fasteners for holding the bars together.

3. A carrying bag according to claim 1, characterized in that said grooves in the legs of the U-shaped handle are provided with outwardly projecting hooks located closely above the first stiffening bar and when the bag is closed said hooks interlock with the crosspiece of the U-shaped member which defines the slot.

4. A carrying bag according to claim 1, characterized in that the U-shaped handle, the U-shaped member and the associated stiffening bars consist of injection moldings made of soft, flexible plastic.

5. A carrying bag according to claim 1, characterized in that the legs of the U-shaped handle are provided with step-forming projections on one side, which is engaged by the crosspiece of the slot-defining U-shaped member when the U-shaped handle has been inserted through the slot, and said projections are adapted to snap over said crosspiece of said U-shaped member.

6. A carrying bag according to claim 5, characterized in that the projections are boss-shaped.

7. A carrying bag according to claim 5, characterized in that the projections are provided with inclined ramp surfaces, which taper toward the outer end of the handle.

8. A carrying bag according to claim 1, wherein the crosspeice of said U-shaped member is longer than a distance between outermost extremities of said grooves of said U-shaped handle.

* * * * *